US005436702A

United States Patent [19]

Katoh

[11] Patent Number: 5,436,702

[45] Date of Patent: Jul. 25, 1995

[54] MEANS FOR EXPOSING ORIGINAL ON IMAGE FORMING APPARATUS TO PROVIDE UNIFORM COPIES

[75] Inventor: Tetsuo Katoh, Tokyo, Japan

[73] Assignee: Kabushkiki Kaisha Toshiba, Kawasaki, Japan

[21] Appl. No.: 123,861

[22] Filed: Sep. 20, 1993

[30] Foreign Application Priority Data

Sep. 21, 1992 [JP] Japan ..... 4-251395
Sep. 10, 1993 [JP] Japan ..... 5-225385

[51] Int. Cl.[6] ..... G03G 15/04
[52] U.S. Cl. ..... 355/243; 355/219; 355/228
[58] Field of Search ..... 355/244, 243, 208, 219, 355/228, 214, 232, 68, 69, 55

[56] References Cited

U.S. PATENT DOCUMENTS 4,480,909 11/1984 Tsuchiya ..... 355/243 X
4,872,035 10/1989 Miyake et al. ..... 355/208
5,267,000 11/1993 Miyamoto et al. ..... 355/214

FOREIGN PATENT DOCUMENTS 54-136845 10/1979 Japan .
54-161185 7/1981 Japan ..... 355/243
56-102867 8/1981 Japan ..... 355/243
57-92342 6/1982 Japan ..... 355/243
57-186769 11/1982 Japan ..... 355/243
4-19636 1/1992 Japan .

*Primary Examiner*—A. T. Grimley
*Assistant Examiner*—Shuk Y. Lee
*Attorney, Agent, or Firm*—Limbach & Limbach

[57] ABSTRACT

An image forming-apparatus of the present invention includes a charging device for applying a first potential and a second potential to a photosensitive drum, a keyboard for inputting a magnification of a copy image to be formed on the photosensitive drum, and a controller for controlling the charging device to control the magnitude of the potentials applied to the photosensitive drum from the charging device in accordance with the magnification input by the keyboard, thus increasing a difference between the first and second potentials in accordance with the degree of variation of the magnification in the case where the magnification input by the keyboard is less than 1.00.

6 Claims, 9 Drawing Sheets

MEANS FOR EXPOSING ORIGINAL ON IMAGE FORMING APPARATUS TO PROVIDE UNIFORM COPIES

BACKGROUND OF THE INVENTION

1. Field of the Invention

This invention relates to an image forming apparatus, and more particularly an apparatus for forming an image which is used in an electrophotographic process.

2. Description of the Related Art

An image forming apparatus, e.g. an electrophotographic copying apparatus, includes an original document table on which an original document to be copied is placed, an illumination device for illuminating the original document placed on the table, a rotatable photosensitive drum on which an image corresponding to the image information of the original document is formed, a charging device for charging the photosensitive drum with a desired charge, and a lens for stabilizing the image information supplied onto the photosensitive drum via the illumination device.

In the copying apparatus, the image information on an original document is illuminated by an illumination device and converted to a bright/dark pattern of reflection light corresponding to the image information. The converted information is transmitted onto a photosensitive drum via a lens. The photosensitive drum is rotated in a desired direction. On the other hand, the illumination device is elongated in a direction (scanning direction) perpendicular to the direction of rotation of the photosensitive drum. Accordingly, the image information on the original document is successively transmitted in accordance with the rotation of the photosensitive drum, in the state in which the information is divided substantially linearly in the scanning direction.

In addition, a copying apparatus of the above type, which can copy an image with a copying magnification varied, is known. In this copying apparatus, the distance between the exposure position and the photosensitive body varies as the optical system for varying the magnification moves and accordingly the length of an optical light path varies. As a result, the amount of light reaching the photosensitive drum differs between the enlargement copying mode and the reduction copying mode, and images with different densities may be formed.

In order to solve the above problem, Jap. Pat. Appln. KOKAI No. 4-19636 discloses a method in which data, which makes the amount of light of an exposure lamp in the enlargement mode greater that in the reduction mode, is pre-stored for each of magnifications, and the pre-stored data is referred to in accordance with the set magnification in order to control the amount of exposure, thereby preventing occurrence of a difference in density associated with the magnification.

The illumination device has a lamp extending in the scanning direction. The image information supplied from the original document onto the photosensitive drum is passed through a lens. It is known that a light intensity distribution based on "rule of $\cos^4$" appears in the scanning direction between the intensity of light (light amount) traveling through a center portion of the lens and the intensity of light (light amount) traveling through a peripheral portion of the lens, i.e. light emitted from both end portions of the lamp.

In consideration of this, a light amount adjusting apparatus is built in many copying apparatuses midway along the light path from the illumination device to the photosensitive drum. The light amount adjusting apparatus functions to correct an intensity distribution provided by the "rule of $\cos^4$."

However, in a general light amount correcting apparatus, the correction amount is determined on the assumption that the magnification ("copying magnification") of a copied image in relation to the image on the original document (i.e. the ratio in size of the copied image to the original image) is 1 (1:1) ("100%-magnification copying mode"). Thus, if the copying magnification is less than 1 (reduction copy mode), the amount of light passing through a peripheral portion of the lens is greater than the amount of light passing through a center portion of the lens.

In the case where, like the prior art, the exposure amount is varied and controlled in accordance with the magnification in order to prevent occurrence of a difference in density due to the magnification, the aforementioned phenomenon (in which the amount of light passing through the peripheral portion of the lens becomes greater than that of light passing through the center of the lens) will occur.

This means that in the reduction-copy mode the luminous intensity on the photosensitive drum at an end portion in the scanning direction increases. Accordingly, as regards the copied image on the photosensitive drum, the latent image potential at an end portion in the scanning direction is lower than that at a center portion.

In this case, there is a problem concerning the image density of the reduction-copied image, that the density at both end portions is lower than that at the center portion. Further, in general, in the reductioncopied image, e.g. an image of a line drawing or a thin-line pattern, the image density tends to be attenuated in relation to development characteristics. Thus, when the image information on the original image contains many line drawings or thin-line patterns, an image defect may occur at both end portions of the copied image.

SUMMARY OF THE INVENTION

An object of the present invention is to provide an image forming apparatus capable of providing a uniform image density on any area of a copied image when an image of an original document is copied.

Another object of the invention is to provide an image forming apparatus capable of forming a copied image with a less difference in image density between a center area and both end areas in the scanning direction in the reduction copying mode.

According to an aspect of the invention, there is provided an image forming apparatus forming an electrostatic image on an image bearing member and supplying toner to the electrostatic image so as to develop the image, comprising: means for exposing an original having an image on it; means for charging the image bearing member; means for setting a magnification of an image formation; first means for controlling the exposing means to increase an amount of exposure in accordance with the magnification when the magnification set by the setting means is less than 1.00, and to decrease the amount of exposure in accordance with the magnification when the magnification set by the setting means is more than 1.00; second means for controlling the charging means to increase an amount of charge in accordance with the magnification when the magnification set by the setting means is less than 1.00; means for forming the image of the original, exposed by the exposing means, on the image bearing means which has been charged by the charging means; and means for changing the size of the image to be formed on the image bearing member by the forming means in accordance with the magnification set by the setting means.

According to another aspect of the invention, there is provided an image forming apparatus forming an electrostatic image on an image bearing member and supplying toner to the electrostatic image so as to develop the image, comprising: means for exposing an original having an image on it; first charging means for charging the image bearing member; second charging means for further charging the image bearing member; means for setting a magnification of an image formation; first means for controlling the exposing means to increase an amount of exposure in accordance with the magnification when the magnification set by the setting means is less than 1.00, and to decrease the amount of exposure in accordance with the magnification when the magnification set by the setting means is more than 1.00; second means for controlling the first charging means and the second charging means to increase an output difference between the first and second charging means in a case that the magnification is reduced by the setting means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

An embodiment of the present invention will now be described with reference to the accompanying drawings.

Figure 1:
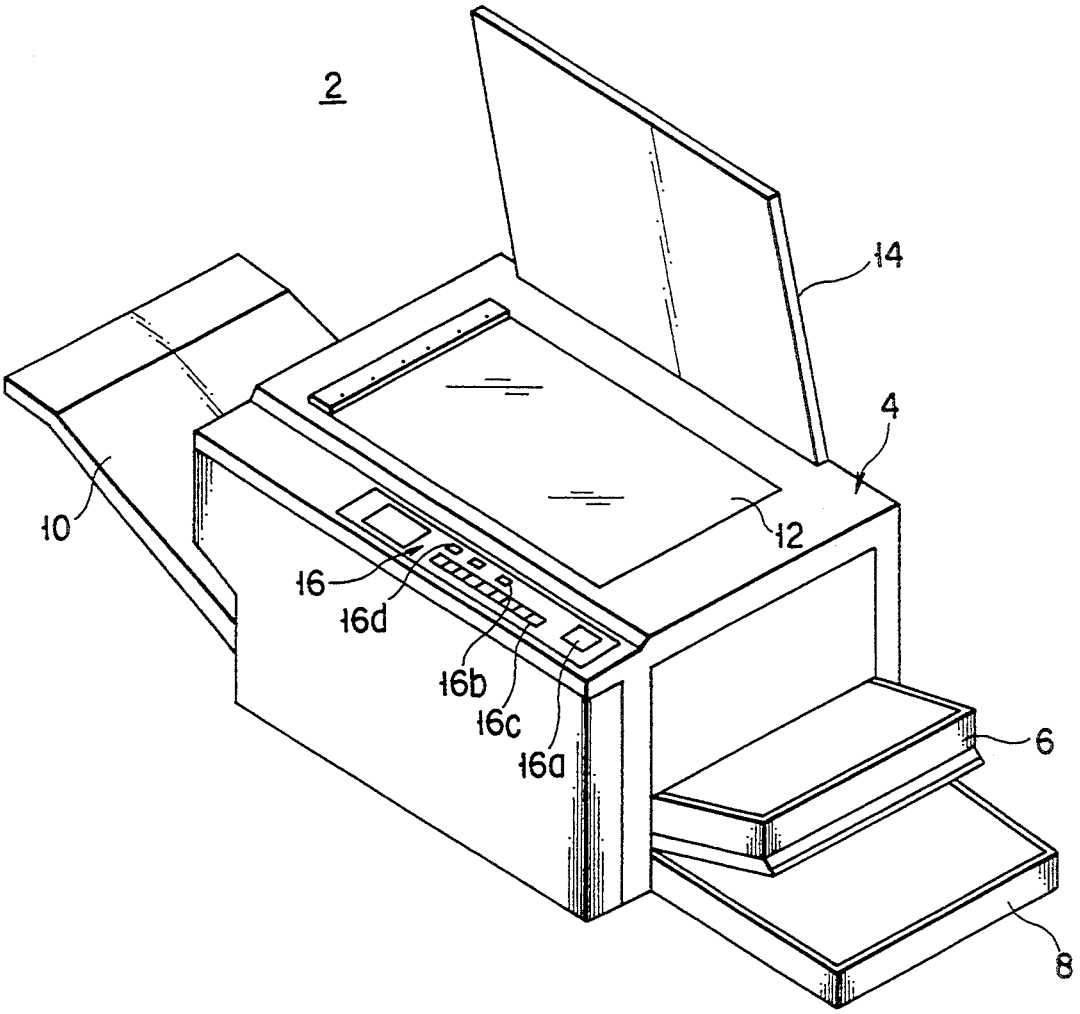
FIG. 1 is a perspective view showing a copying apparatus according to an embodiment of the present invention.
Figure 2:
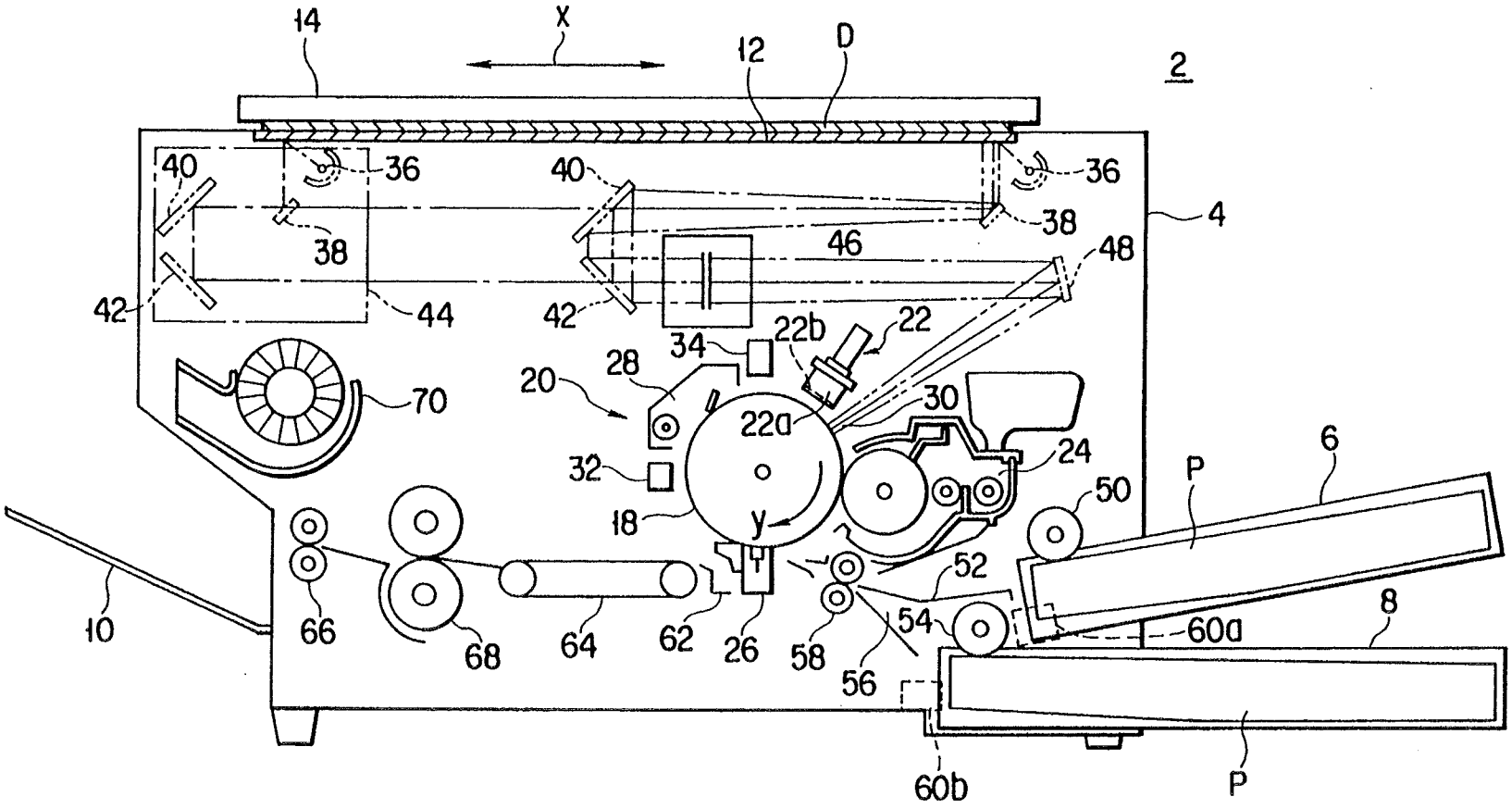
FIG. 2 is a cross-sectional view of the copying apparatus shown in FIG. 1.

Referring to FIGS. 1 and 2, a copying apparatus 2 includes an image forming unit (described later). The copying apparatus 2 has an apparatus body 4 for copying the image on an original document D or an object to be copied, first and second sheet cassettes 6 and 8, arranged detachably on one side of the body 4, for feeding copying paper sheets P into the body 4, and a tray 10, arranged on a side of the body 4 opposed to the side on which the sheet cassettes 6 and 8 are mounted, for receiving the sheets P copied by means of the image forming unit.

On the upper part of the apparatus body 4, there are provided an original document table 12, an original document cover 14, and an operation panel 16. The table 12 is made of a transparent glass, for supporting the original document D. The original cover 14 is provided openably on the table 12, for covering the upper surface of the original table 12 and bringing the document D into close contact with the table 12. The operation panel 16 includes input switches for inputting a copy start signal, a copying magnification signal, etc., e.g. a print key **16*a*, a copying magnification input key (zoom key) 16*b*, a number-of-copies setting key (number key) 16*c*, and/or a sheet cassette switching key 16*d*. The operation panel 16 functions to input to the body 4 information for actuating the body 4**.

An image forming unit 20 is situated at a substantially center area within the body 4. The image forming unit 20 includes a photosensitive drum 18 which is rotated in a y-direction. An image is formed on the drum 18 by an electrophotographic process.

The image forming unit 20 comprises a charging unit 22, a development unit 24, a transfer unit 26, and a cleaning unit 28. The charging unit 22 includes a corona wire **22*a* and a grid electrode 22*b* and applies a desired potential to the photosensitive drum 18. The development unit 24 develops an electrostatic latent image formed on the drum 18 by supplying toner onto the electrostatic latent image. The transfer unit 26 transfers the toner image formed on the photosensitive drum 18 onto the sheet P fed from either the sheet cassette 6 or 8. The cleaning unit 28 removes the toner remaining on the photosensitive drum 18 from the drum 18. The charging unit 22, development unit 24, transfer unit 26, and cleaning unit 28 are arranged so as to surround the photosensitive drum 18 successively in the direction of rotation of the drum 18**.

A slit region 30 is formed between the charging unit 22 and development unit 24 around the photosensitive drum 18. Image information to be copied is transmitted through the slit region 30 via a read optical system (described later). A discharging unit 32 for preventing electrostatic attraction of the toner remaining on the photosensitive drum 18 and the drum 18 is provided between the transfer unit 26 and cleaning unit 28. An erasing lamp 34 for erasing an electrostatic latent image remaining on the photosensitive drum 18 is provided between the cleaning unit 28 and the charging unit 22.

A read optical system 44 and a lens block 46 are arranged above the image forming unit 20 and below the original document table 12. The read optical system 44 includes an illumination lamp 36, which extends in a direction (scanning direction) perpendicular to the direction of rotation of the photosensitive drum 18 and illuminates the original document D on the table 12, and first to third reflection mirrors 38, 40 and 42 extending similarly with the illumination lamp 36. The read optical system 44 is movable in an x-direction below the lower surface of the table 12. The lens block 46 is arranged in a plane including the optical axis defined by the read optical system 44 so as to be movable along the optical axis. The lens block 46 adjusts the characteristics of reflection light from the original document D, i.e. image information on the document D read by means of the read optical system 44, and focuses the image information on the photosensitive drum 18 at a desired magnification. A light-path turning mirror 48 is situated between the lens block 46 and the photosensitive drum 18 so as to be movable in the plane including the optical axis of the read optical system along the optical axis. The light-path turning mirror 48 turns the light path of the reflection light emitted from the lens block 46 towards the photosensitive drum 18 and adjusts the focusing condition unless the copying magnification is 1:1 (100%).

Feed roller mechanisms 50, 54, guide paths 52 and 56 and a register roller 58 for feeding the copying sheets P contained in the cassettes 6 and 8 from the cassettes 6 and 8 to the photosensitive drum 18 are arranged between the photosensitive drum 18 (image forming unit 20) and the cassettes 6 and 8. The register roller 58 corrects the inclination of sheet P pulled out from the cassette 6, 8, and also aligns the sheet P with the toner image formed on the drum 18 and moved in accordance with the rotation of the drum 18. Cassette size detectors **60*a* and 60*b* for detecting the size of the sheet P contained in the cassette 6, 8 are arranged at positions where the front end portions of the cassettes 6 and 8 are placed when the cassettes 6 and 8** are inserted.

Between the photosensitive drum 18 (image forming unit 20), and the tray 10, there are provided a separating charging unit 62, a convey belt 64, and sheet discharge rollers 66. The separating charging unit 62 separates the sheet P, onto which the toner image has been transferred by means of the transfer unit 20, from the photosensitive drum 18. The separated sheet P is conveyed towards the tray 10 by means of the convey belt 64. A fixing unit (pair of fixing rollers) 68 for fixing the toner image on the sheet P is situated between the convey belt 64 and sheet discharge rollers 66. A cooling fan 70 for preventing a temperature rise in the apparatus body 4 is provided above the fixing unit (pair of fixing rollers) 68.

The developing unit 24 has a two-component developing agent (not shown), developing rollers **24*a*, and mixing rollers 24*b* and 24*c*. The two-component developing agent contains toner and carrier at a desired ratio. The developing rollers 24*a* supply toner onto an electrostatic latent image formed on the photosensitive drum 18. The mixing rollers 24*b* and 24*c* mix the toner and carrier to electrify them frictionally. (The toner being charged triboelectricaly by the mixing rollers 24*b* and 24*c* are rotated.) The developing unit 24 is provided with a toner hopper 24*d*** for replenishing the toner which is consumed as the copying operation (image formation) is repeated.

Figure 3:
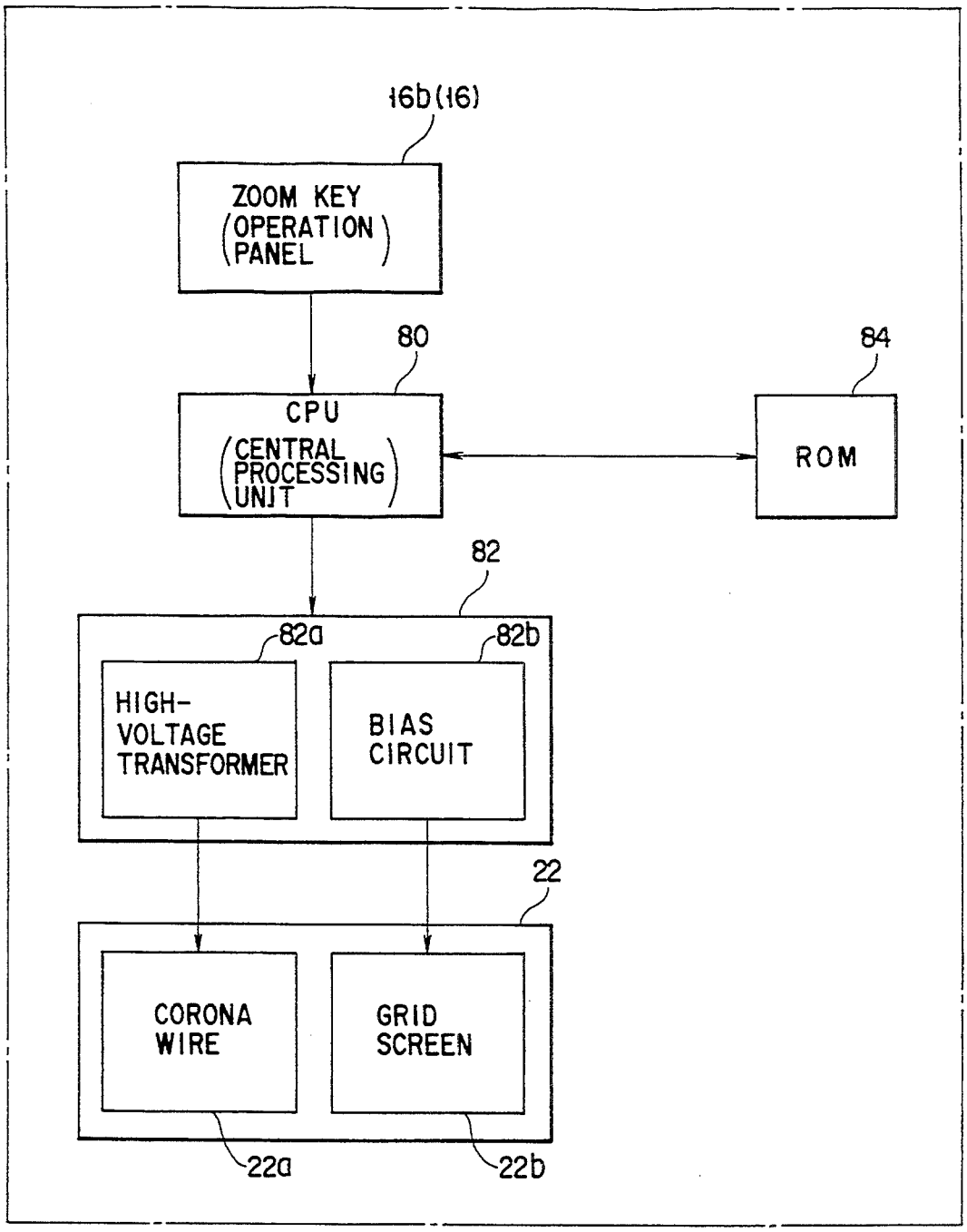
FIG. 3 is a block diagram relating to the copying apparatus shown in FIGS. 1 and 2 and schematically showing electrical connection of main elements.

As is shown in FIG. 3, the copying apparatus 2 includes a CPU 80 for rotating a driving motor (not shown), e.g. a servo motor, on the basis of the copying conditions input from the operation panel 16, and activating the charging unit 22, illumination lamp 36, transfer unit 26, and separating charging unit 62, and controlling a series of copying operations for pulling out the sheet P from the cassette 6, 8 and transferring the copy image formed on the photosensitive drum 18 onto the sheet P. CPU 80 is connected to the operation panel 16 via an interface (not shown). The CPU 80 is connected via an I/O port (not shown) to a charging output circuit 82 (a high-voltage transformer **82*a* and a bias circuit 82*b*) for varying a primary charging voltage applied to the corona wire 22*a* of the charging unit 22 and a grid voltage applied to the grid electrode 22*b*. The grid voltage applied to the grid electrode 22*b* is determined by bias circuit 82*b*. The CPU 80 activates the copying apparatus 2 on the basis of the data stored in a ROM 84 and controls the voltage applied from the bias circuit 82*b* of the charging output circuit 82 to the grid electrode 22*b* of the charging unit 22 in accordance with a copying magnification input from the operation panel 16**.

The image forming operation of the copying apparatus 2 will now be described.

The original document D to be copied is placed on the original document table 12, and the original document cover 14 is closed. The original document D is put in close contact with the table 12 by means of the cover 14.

Copying conditions, e.g. the number of copies, the copying magnification, the density of copied image, and the size of sheet P, are input from the operation panel 16, and the print key **16*a* is turned on. Thus, the image forming operation is initiated. On the basis of the copying magnification input by the copying magnification input key 16*b*, the quantity of an electric charge applied from the charging unit 22 to the photosensitive drum 18 is determined, as illustrated in a flow chart of FIG. 9, described later. Specifically, on the basis of the copying magnification input from the operation panel 16, the output of the bias circuit 82*b* of the charging output circuit 82** is set.

When the print key **16*a* is turned on, a driving motor (not shown) is activated, and the photosensitive drum 18 is rotated at a desired speed. Subsequently, the charging unit 22 is activated, and a desirably set charge (which is generally determined as a surface potential by measuring a potential produced by the applied charge) is applied to the photosensitive drum 18 and aged. At the same time, the lens block 46 and light-path turning mirror 48 are moved to a desired position in accordance with the magnification input by means of the copying magnification input key 16***b*, and an image focusing system corresponding to the copying magnification is constituted.

The output from the corona wire 22*a* controlled by the potential applied to the grid electrode 22*b* by the bias circuit 82*b* is applied to the photosensitive drum 18.

Thereafter, the read optical system 44 is moved by means of a servo motor (not shown). At the same time, the illumination lamp 36 is turned on to illuminate the original document D put in close contact with the original table 12. Accordingly, the image information on the original document D is transmitted in units of a substantially linear portion in the scanning direction in accordance with the rotation of the photosensitive drum 18.

The image information contained in the original document D is illuminated, and the reflection light converted to a bright/dark pattern in accordance with the image information is made incident on the first reflection mirror 38. The light incident on the first reflection mirror 38 is successively reflected by the second and third reflection mirrors 40 and 42 and input to the lens block 46. The reflected light which has been provided with a desired magnification through the lens block 46 is turned by the light-path turning mirror 48 and passed through the slit region 30. The light enamoring from the slit region 30 is radiated on the photosensitive drum 18 (charged at a desired potential).

The surface potential on the photosensitive drum 18 is selectively decreased, and thereby the reflection light radiated on the drum 18 is converted to an electrostatic latent image. The toner is supplied from the developing unit 24 and the electrostatic latent image is converted (developed) to a toner image.

In parallel with the above series of operations, one of the cassettes 6 and 8 which contains sheets P of suitable size is selected in accordance with the input from the sheet cassette switching key 16*d* or in accordance with a combination of the magnification input by the copying magnification input key 16*b* and the size of the original document. Subsequently, one sheet P is fed towards the photosensitive drum 18 via the combination of the feed roller mechanism 50 and guide path 52 or the combination of the feed roller mechanism 50 and guide path 56 in accordance with the selected cassette. The sheet P, which is being fed towards the photosensitive drum 18, is temporarily stopped via the register roller 58, and the sheet P is aligned with the toner image on the drum 18, which toner image is conveyed in accordance with the rotation of the drum 18. Then, the sheet P is fed towards the photosensitive drum 18 once again.

The sheet P fed via the register roller 58 is adsorbed on the outer peripheral surface of the drum 18 by the charge remaining on the drum 18 (which charge does not serve for image development). The sheet P is conveyed in accordance with the rotation of the drum 18 at the same speed as the outer periphery of the drum 18 moves. In this state, the transfer unit 26 is activated, and the charge of the same polarity as the charge supplied to the drum 18 by means of the charging unit 22 is applied to the rear face of the sheet P. Thus, the toner image on the drum 18 is electrostatically transferred onto the sheet P.

The sheet P, on which the toner image has been transferred, is separated from the outer periphery of the photosensitive drum 18 by an AC charge supplied from the separating charging unit 62 and by natural separation due to a difference between the curvature of the outer periphery of the drum 18 and the bending properties of the sheet P. The sheet P, which has been separated from the drum 18 and simply carries the toner image, is guided to the fixing unit 68 via the convey belt 64. The toner image carried on the sheet P is fixed on the sheet P by the fixing unit 68. The sheet P, on which the toner image has been fixed, is discharged out of the apparatus body 4 via the discharge rollers 66, and stocked on the tray 10 projecting from the body 4.

On the other hand, the residual toner of the toner image which has been transferred onto the sheet P by the transfer unit 26 is guided to the cleaning unit 28 in accordance with the rotation of the drum 18 and recovered by the cleaning unit 28. In this case, the residual toner is adsorbed on the drum 18 by the residual potential on the drum 18. Thus, prior to the recovery by the cleaning unit 28, the discharging unit 32 releases electrostatic adsorption of the residual toner on the drum 18. For the formation of the next image, erasing light is radiated from the erasing lamp 34 onto the drum 18 from which the residual toner has been removed by the cleaning unit 28. By the radiation of the erasing light, the charge distribution pattern (electrostatic latent image) remaining on the photosensitive drum 18 is erased, and the photo-electric conversion performance of the drum 18 is restored to the initial state.

Next, the movement of the lens block 46 and the light amount (drum surface illumination illuminance) on the outer peripheral surface of the drum 18 will now be considered in the variable-magnification (reduction or enlargement) copying mode.

Figure 4:
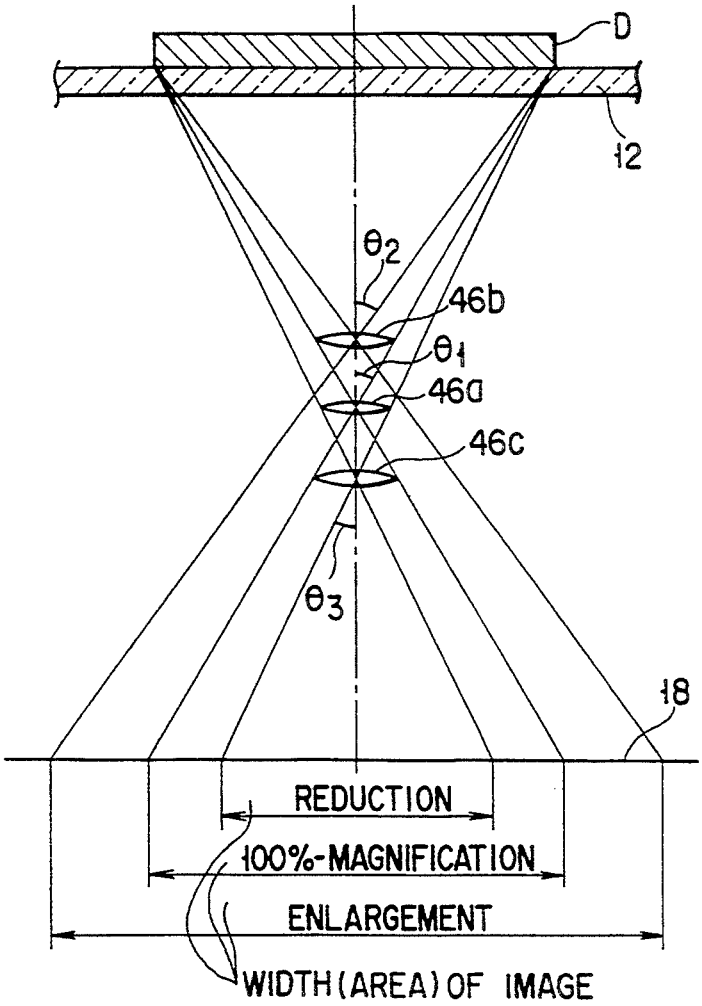
FIG. 4 is an optical path diagram relating to the copying apparatus shown in FIGS. 1 to 3 and showing the position of a lens (block) in relation to the copying magnification, and the relationship between the position of the lens and the areas of images focused on a photosensitive drum.

FIG. 4 shows the light paths from the surface of the original document D (or the upper surface of the original document table 12) to the photosensitive drum 18 through the lens block 46. The lens block 46 functions to desirably vary the magnification of the image to be formed on the drum 18 in relation to the size of the original document D.

As is clear from FIG. 4, the lens 46 is moved along the light axis in the variable-magnification copying mode. In this case, the image angle $\theta$ defined between the original document D and the lens 46 is varied in accordance with the position of the lens 46. The relationship between the image angle $\theta_1$ in the 100%-magnification copying mode, the image angle $\theta_2$ in the enlargement copying mode, and the image angle $\theta_3$ in the reduction copying mode are expressed by $$\theta_3<\theta_1<\theta_2$$

Figure 5:
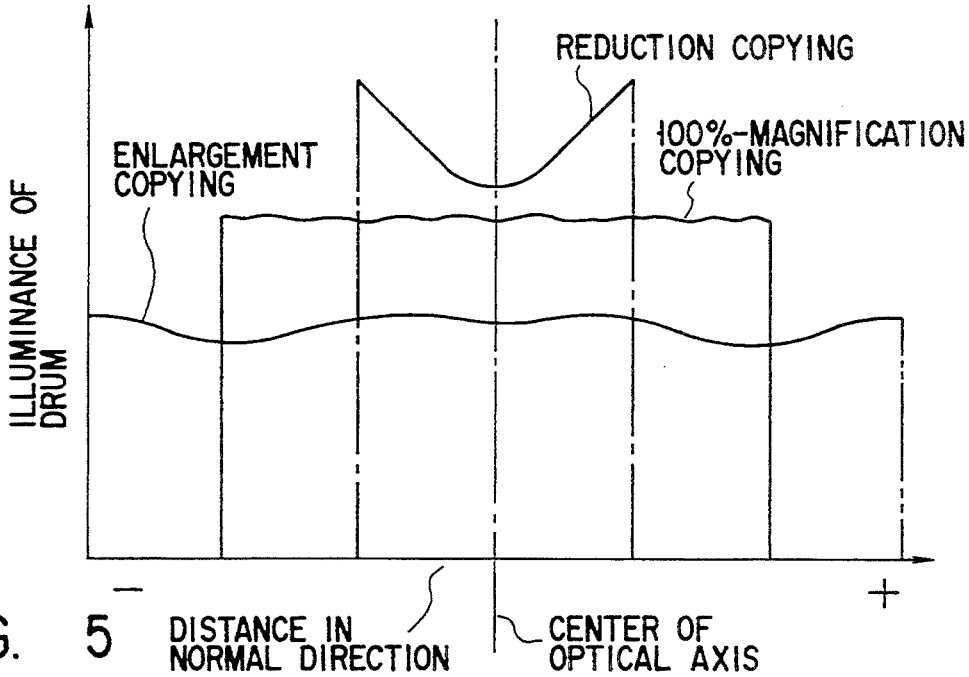
FIG. 5 is a graph showing the luminous intensity on the photosensitive drum with respect to the light transmitted from an illumination lamp to the photosensitive drum along the optical paths shown in FIG. 4.

On the other hand, when the image information of the original document D is copied, the size of the image information area (i.e. "copyable information area") on the original document corresponding to the image output to the sheet P is defined by the size of sheet P and the copying magnification. Thus, when the size of the sheet P is fixed in the variable-magnification copying apparatus, the size of the copyable information area is smaller in the enlargement copying mode than in the 100%-magnification copying mode and it is greater in the reduction copying mode than in the 100%-magnification copying mode. In addition, as is clear from FIG. 5, when the intensity (amount) of light output from the illumination lamp 36 is constant, the illuminance on the photosensitive drum 18 is lower in the enlargement copying mode than in the 100%-magnification copying mode and it is higher in the reduction copying mode than in the 100%-magnification copying mode.

From this, it follows that the illuminance (illuminance on the original document surface) on the original document D illuminated by the illumination lamp 36 must be higher in the enlargement copying mode than in the 100%-magnification copying mode and it must be lower in the reduction copying mode than in the 100%-magnification copying mode.

More specifically, the following equations (1) and (2) are obtained in connection with the light traveling from the original document surface towards the photosensitive drum (the reflection light of the light emitted from the illumination lamp 36):

$$I_0 = L_0 \cdot \Delta S \quad (1)$$

$$\Delta S' = m^2 \cdot \Delta S \quad (2)$$

wherein $L_0$=the brightness of light of illumination lamp 36 radiated on the original document D in the normal direction (i.e. scanning direction), $I_0$=the intensity of light on the surface of the original document D (i.e. the surface to be copied, put in close contact with the original document table 12), $\Delta S$=the area of the original document D illuminated by the illumination lamp 36, $\Delta S'$=the area of the image projected on the photosensitive drum 18 in accordance with the area $\Delta S$, and m=the magnification (copying magnification).

Furthermore, the following equations (3), (4) and (5):

$$\begin{aligned} \Phi_0 &= I_0 \cdot \Omega \\ &= L_0 \cdot \Delta S \times (D/2)^2 \cdot \pi / a^2 \end{aligned} \quad (3)$$

$$a = f \times (1 + 1/m) \quad (4)$$

$$F = f/D \quad (5)$$

wherein $\Phi_0$=the total light beam incident on the lens (lens block) 46, $\Omega$=the angle of the direction from the original document D to the lens 46, a=the light path angle from the original document surface to the front-side major surface of the lens, D=the effective diameter of the lens 46, and F=the aperture/focal distance ratio (numerical aperture) of the lens 46.

The following equations (6) and (7) are also obtained:

$$\Phi_0' = \tau \cdot \Phi_0 \quad (6)$$

$$E_0 = \Phi_0' / \Delta S' \quad (7)$$

wherein $\tau$=the transmittance of the lens 46, $\Phi_0'$=the total light beam radiated on the area $\Delta S'$ of the projected image on the photosensitive drum 18, and $E_0$=the image face illuminance on the projected image on the photosensitive drum 18.

By rearranging the above equations, the following equation (8) can be obtained:

$$E_0 = (\mu \cdot \tau \cdot L_0)/4F^2 \times (1+m)^2 \quad (8)$$

As has been explained above, in order to maintain the image face illuminance $E_0$, irrespective of the copying magnification m, the light intensity $I_0$ on the original document surface, i.e. the brightness $L_0$ of the lamp illuminating the original document D, must be increased in the case where "m" is greater than 1 (i.e. in the enlargement copying mode). On the other hand, in the case where "m" is less than 1 (i.e. in the reduction copying mode), the light intensity $I_0$ on the original document surface, i.e. the brightness $L_0$ of the lamp, must be decreased. It should be noted that equations (1) to (8) hold true with respect to the system in which the focal distance f of the lens (lens block) 46 is constant irrespective of m and the total light path length is varied in accordance with the copying magnification (the light-path turning mirror 48 is moved in accordance with the copying magnification).

Consideration will now be given to the case where, for example, a zoom lens is used as a lens block (i.e. the lens itself varies the focal distance in accordance with the variation of the copying magnification and thereby the total light path length is kept constant. In this case, the focal distance f of the zoom lens is varied in accordance with the copying magnification m, and, therefore, if the focal distance is fm, equation (4) can be modified as follows:

$$a = fm \times (1 + 1/m) \quad (9)$$

In this case, equation (8) is rewritten as, $$E_0 = (\mu \cdot \tau \cdot L_0)/4Fm^2 \times (1+m)^2 \quad (10)$$

wherein

Fm=the numerical aperture corresponding to the focal distance fm.

On the other hand, regarding the zoom lens, the total light path length is constant irrespective of the copying magnification m. Thus, if the focal length in the 100%-magnification copying mode is $f_0$, the following equation (11) is satisfied:

$$fm \times (1+1/m) + mfm \times (1+1/m) = 2f_0 + 2f_0 \quad (11)$$

Since $fm = 4 \cdot f_0/(m+1/m+2)$, equation (10) can b rewritten as, $$E_0 = \frac{(\pi \cdot \tau \cdot L_0)}{4F_0^2\{4/m + (1/m) + 2\}^2 (1 + m^2)} \propto L_0 \left(1 + \frac{1}{m}\right)^2$$

Accordingly, in order to keep constant the image face illuminance $E_0$ irrespective of the copying magnification, even when the zoom lens is used, as in the case of using the aforementioned lens block 46, the following condition must be satisfied: the light intensity $I_0$ on the original document surface, i.e. the illuminance $L_0$ of the lamp illuminating the original document D, is increased when "m" is greater than 1 (i.e. the enlargement copying mode), and the light intensity $I_0$ on the original document surface, i.e. the illuminance $L_0$ of the lamp, is decreased.

Figure 9:
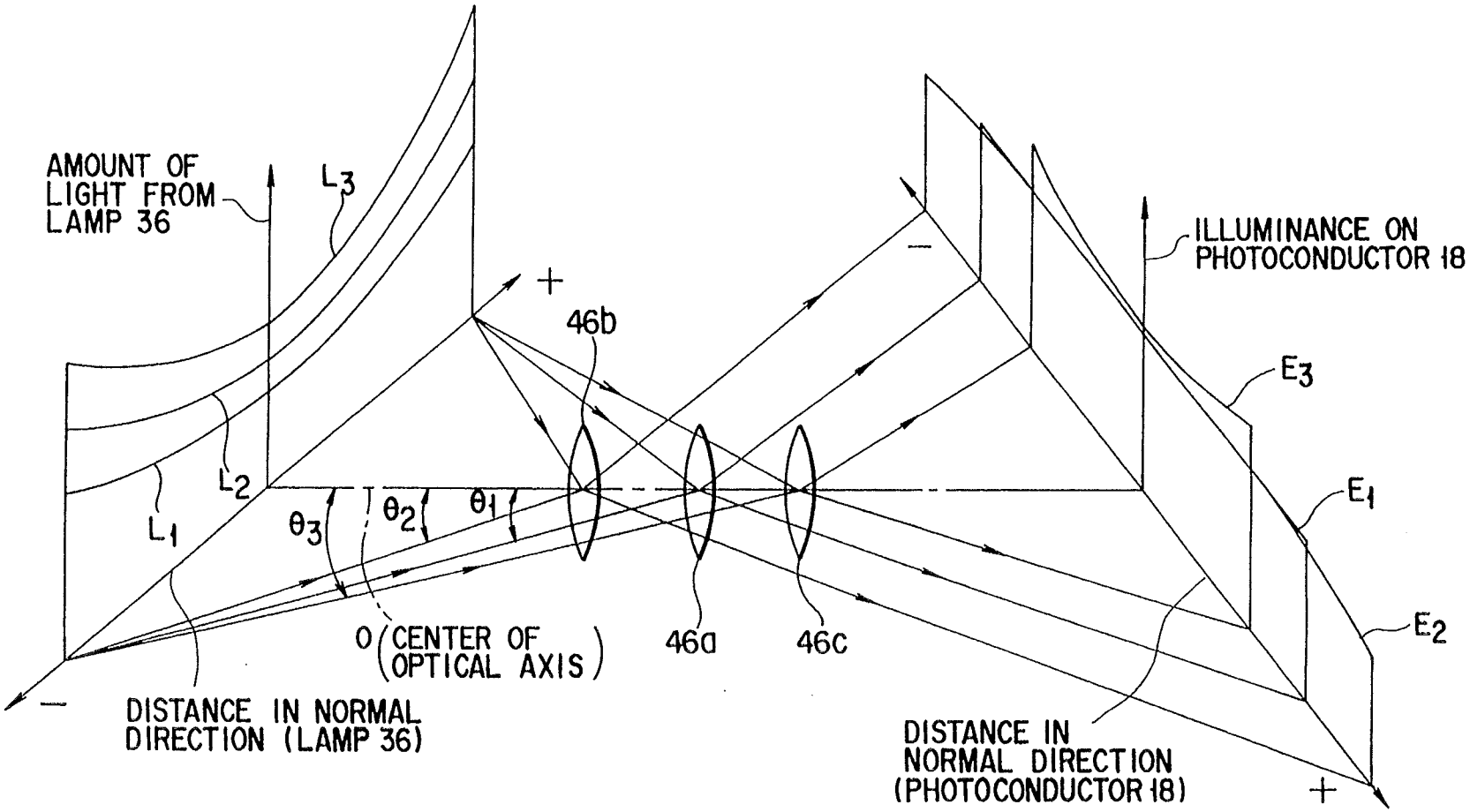
FIG. 9 (PRIOR ART)
FIG. 9 is a graph showing the relationship between the output of the light source used for illuminating the original document and the copying magnification, with respect to the light transmitted to the photosensitive drum in a conventional copying apparatus.

In the optical system shown in FIG. 4, equation (8) or (10) is applied, and the light mount L of the illumination lamp 36 is varied in accordance with the copying magnification. Accordingly, even when the copying magnification is varied, as shown in FIG. 9, the illuminance E of the photosensitive drum 18 is kept constant. In FIG. 9, the positions 46*a*, 46*b* and 46*c* of the lens (lens block) 46 are determined in accordance with the 100%-magnification copying mode, enlargement copying mode (with a desired magnification) and reduction copying mode (with a desired magnification). Similarly, $L_1$to $L_3$ and $E_1$ to $E_3$ indicate the amounts of light from the illumination lamp 36 and the illuminances on the photosensitive drum 18, which are determined in accordance with the 100%-magnification copying mode, enlargement copying mode (with a desired magnification) and reduction copying mode (with a desired magnification).

However, in the example as shown in FIG. 9, the intensity (amount) of light emitted from the illumination lamp 36 is provided with characteristics for correcting the light intensity distribution provided on the basis of the "rule of $\cos^4$. " Accordingly, as seen from $E_3$ indicating the luminance in the reduction mode (in FIG. 9), the luminance of both end portions of the image on the photosensitive drum 18 becomes higher than that of a center portion of the image, in particular, in the reduction mode.

Suppose that the illumination lamp 36 is caused to emit light $L_1$ having a desired intensity distribution (the light amount in a peripheral area is greater than that in a center area) so as to obtain a substantially uniform illuminance $E_1$ in the 100%-magnification copying mode with respect to the illuminance E on the photosensitive ,drum 18, despite the light amount L of the illumination lamp 36 being varied in accordance with the copying magnification. In this case, the illuminance $E_2$ is lowered in the peripheral area in the enlargement copying mode, and especially the illuminance $E_3$ is raised in the peripheral area in the reduction copying mode.

Figure 10A:
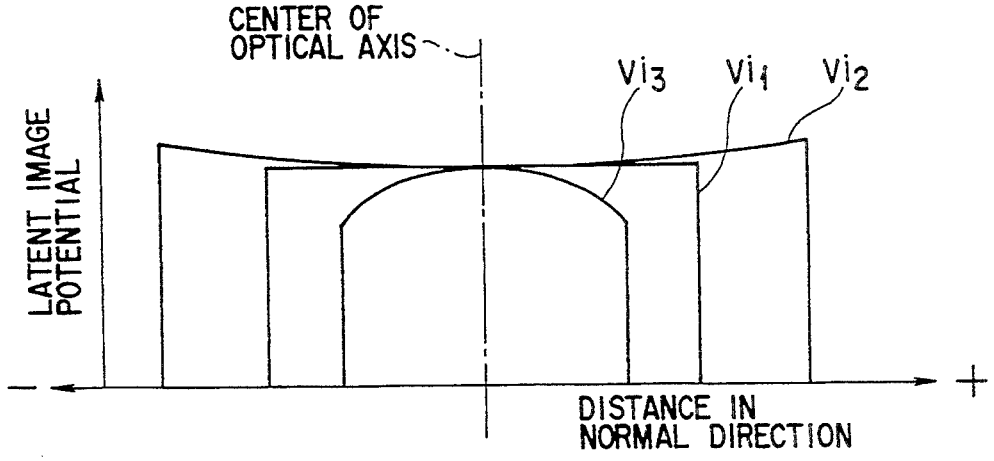
FIG. 10A (PRIOR ART)
FIG. 10A is a graph showing, in a similar manner with FIG. 6A, the relationship between the light transmitted to the photosensitive drum and the latent image potential on the photosensitive drum surface in the conventional copying apparatus.
Figure 10B:
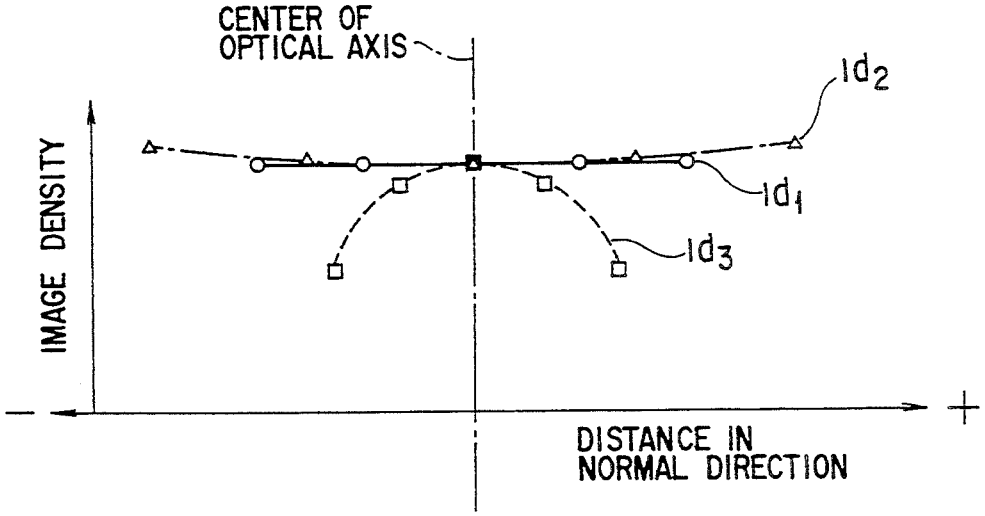
FIG. 10B (PRIOR ART)
FIG. 10B is a graph showing, in a similar manner with FIG. 6B, the relationship between the light transmitted to the photosensitive drum and the image density of the copied image in the conventional copying apparatus.

As is clear from FIG. 10A, as regards the latent image potential Vi on the photosensitive drum 18, the potential $Vi_3$, which is lower than the latent image potential $Vi_1$ in the 100%-magnification copying mode, is applied on the peripheral area in the reduction copying mode. The potential $Vi_2$, which is higher than the latent image potential $Vi_1$ in the 100%-magnification copying mode, is applied on the peripheral area in the enlargement copying mode. Accordingly, as regards the image density Id of the copy image output from the copying apparatus 2, the image density $Id_3$ of the reduction-copied image is lower in both end areas than in the center area, as compared to the substantially uniform image density $Id_1$ of the 100%-magnification copy image, as shown in FIG. 10B. In this case, there is no problem, the user may have an impression that the image on the obtained copy is blurred, and he/she may think that the copying apparatus 2 is malfunctioning. Of course, the density $Id_2$ which is higher in both end portions than in the center portion is obtained, which the user considers generally desirable.

Figure 6A:
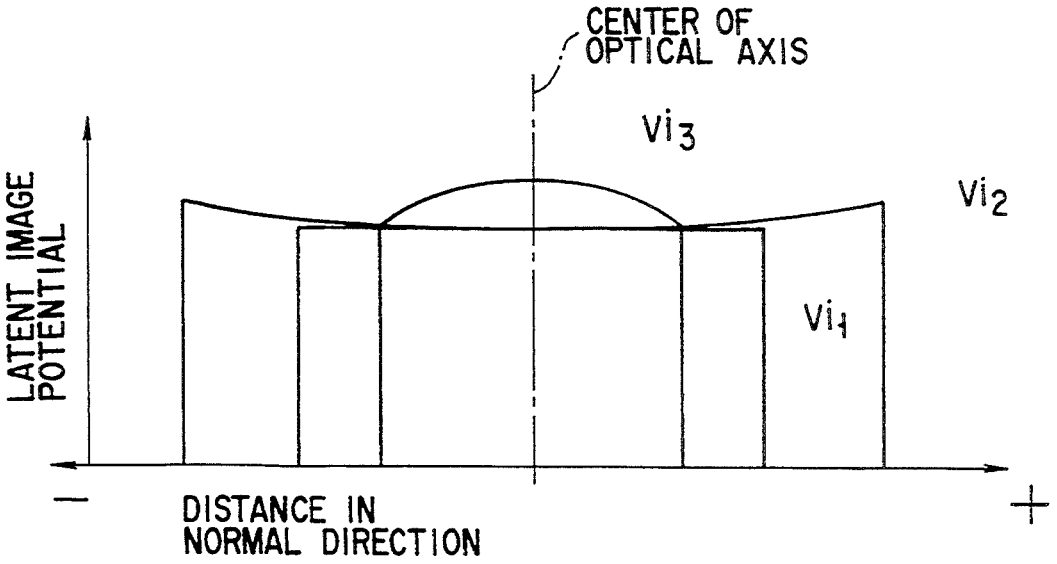
FIG. 6A is a graph showing a latent image potential on the photosensitive drum surface, which is applied by light transmitted from the illumination lamp to the photosensitive drum.
Figure 6B:
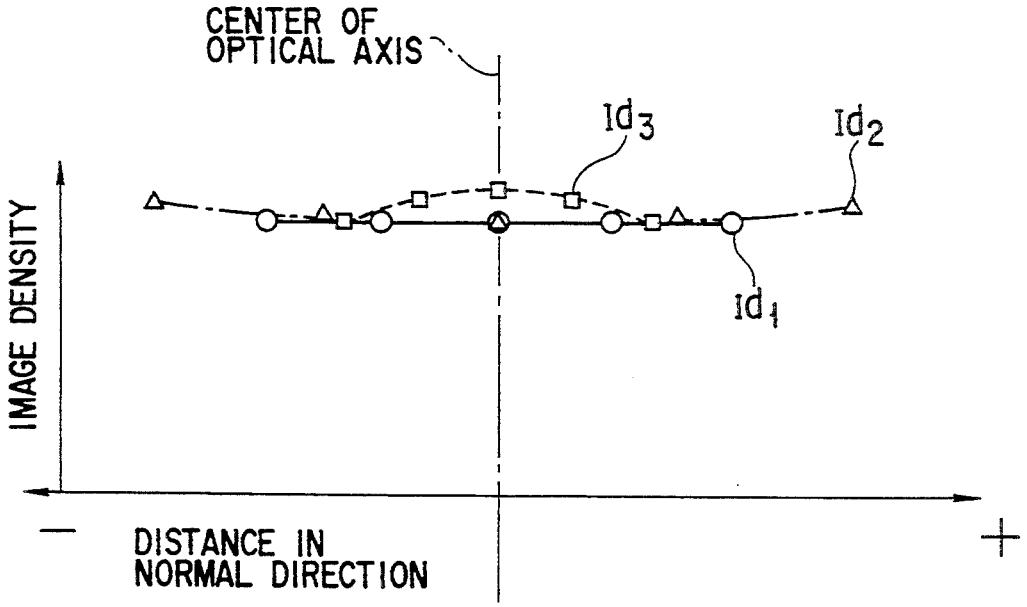
FIG. 6B is a graph showing the relationship between the light transmitted from the illumination lamp to the photosensitive drum and the image density of the copied image.

According to the copying apparatus of the present embodiment, in particular, the latent image potential Vi3 on the photosensitive drum 18 in the reduction mode is corrected, as shown in FIG. 6A, and thereby the image density Id3 in the reduction mode is generally increased, as shown in FIG. 6B. Thus, a decrease in density at both end portions of the image in the reduction mode can be prevented.

In the copying apparatus of this embodiment, the CPU 80 controls the charging unit 22 such that the surface potential of the photosensitive drum 18 is increased in the image reduction mode, thereby increasing the image density Id3 of the reduction-copied image. In this case, the surface potential on the photosensitive body 18 can be varied by limiting the main charge amount produced by the voltage applied to the corona wire 22*a* via the high-voltage transformer 82*a* on the basis of the voltage applied to the grid electrode 22*b* via the bias circuit 82*b*. The grid voltage data corresponding to the reduction magnification is stored in the ROM 82*b*.

When the reduction magnification has been set by the operator via the operation panel 16, the CPU 80 reads out the grid voltage data from the ROM 80 in accordance with the set magnification and controls the bias circuit 82*b* so as to keep the voltage value of the grid electrode 22*b* at a value corresponding to the grid voltage represented by the grid voltage data. In this apparatus, a predetermined value of main charge amount, e.g. −800V, is constantly output from the corona wire 22*a*. On the other hand, by varying the grid voltage, the amount of charge after passage through the grid electrode 22*b*, i.e. the amount of charge applied to the photosensitive drum 18, is varied.

An example of a control process for adjusting the amount of charge output from the charging unit 22 in accordance with the input reduction magnification will now be described with reference to FIG. 7. Specifically, FIG. 7 illustrates an example of a control process for controlling the surface potential supplied to the photosensitive drum 18.

Figure 7:
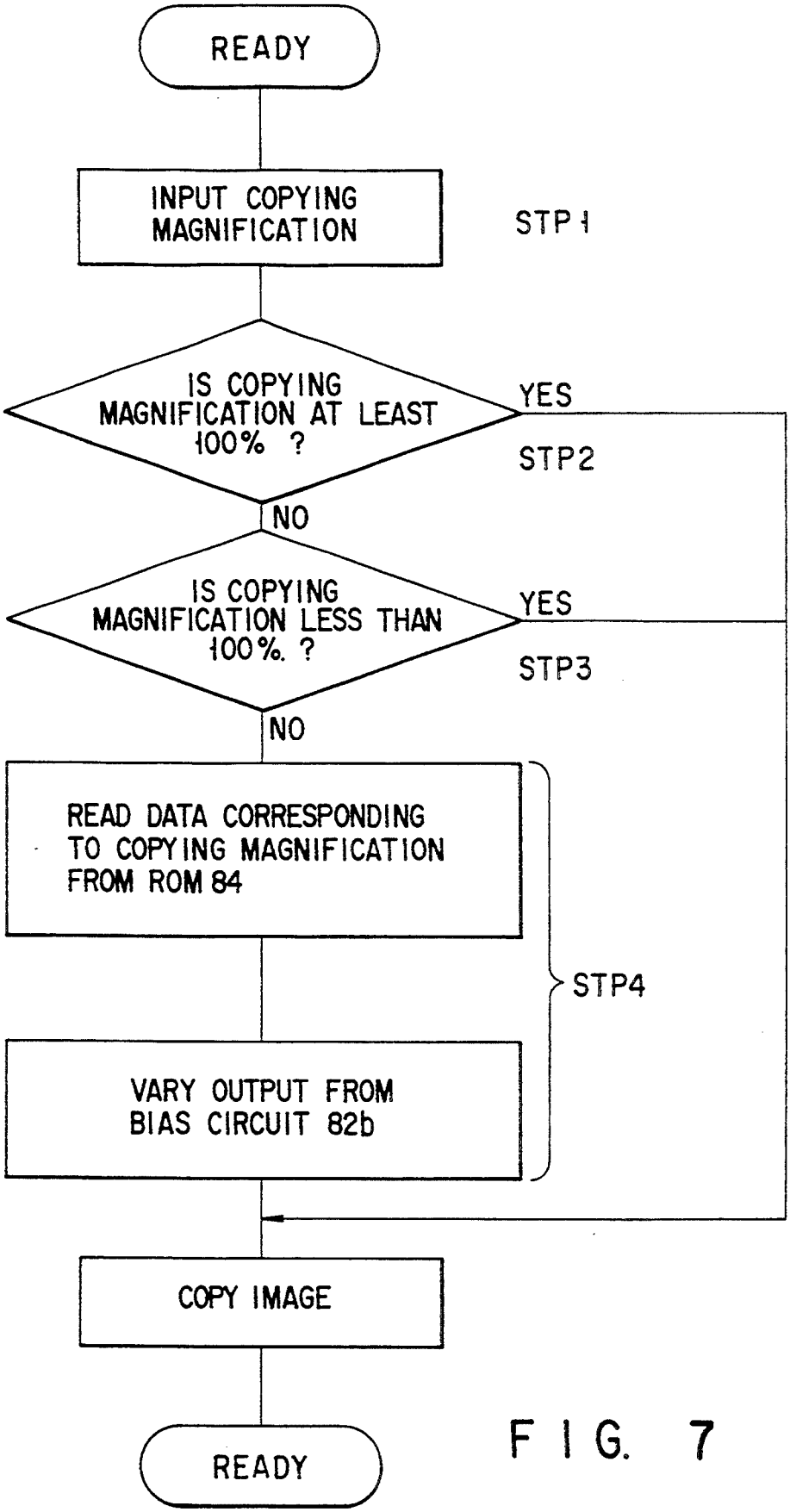
FIG. 7 is a flow chart illustrating a process of varying the effective surface potential of the photosensitive drum which is determined by the copying magnification in the copying apparatus shown in FIGS. 1 to 3.
Figure 8A:
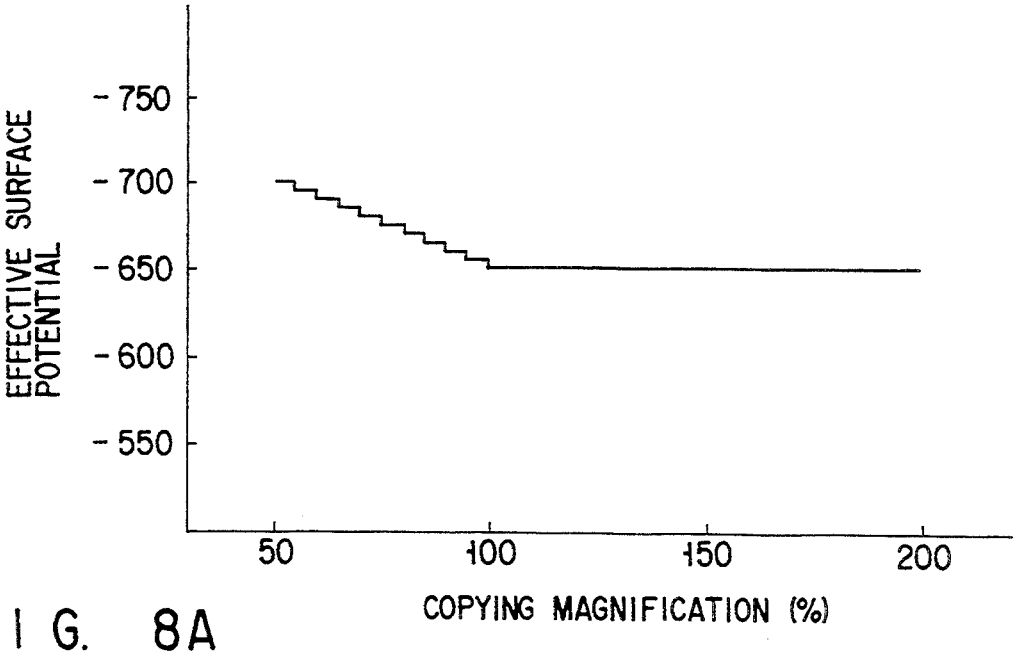
FIG. 8A is a graph showing the relationship between the copying magnification and the effective surface potential of the photosensitive drum in the copying apparatus shown in FIGS. 1 to 7.

Referring to FIG. 7, the copying magnification is input via the copying magnification input key 16*b* (STP 1). It is determined whether or not the input magnification is at least 100% (STP 2 and STP 3). If the input copying magnification is less than 100%, the output of the bias circuit 82*b* for applying a grid voltage is controlled on the basis of the data stored in advance in ROM 84 so that the grid voltage applied to the grid electrode 22*b* may have a desired magnitude (STP 4). In this case, for example, as is shown in FIG. 8A, the output from the bias circuit 82*b* is controlled in a stepwise manner successively or in accordance with the magnification so that the absolute value of the grid voltage increases as the copying magnification decreases from 100% (i.e. the "named effective surface potential" indicated by the difference between the surface potential and the bias voltage increases).

More specifically, the effective surface potential is determined by controlling the outputs of the corona wire (main electrification element) 22*a* and the grid electrode (bias electrification element) 22*b* by means of an electrification output circuit 82 so that the effective surface potential becomes, normally, −650 volt. That is, when the magnification is 1.00 (100%) or more than 1.00, for example, −800 volt is applied to the corona wire 22*a*, and −770 volt is applied to the grid electrode 22*b*, so that the effective surface potential on the photosensitive drum 18 is −650 volt. On the other hand, the bias voltage output from the grid electrode 22*b* is increased, for example, in units of about 5 V (absolute value) as the magnification decreases by 0.05 (the range of variation amount=0.05). In other words, when the magnification is in the range of 0.00 to 0.95, the voltage of −775 volt is output from the grid electrode 22b, and when the magnification is in the range of 0.94 to 0.90, the voltage of −780 volt is output from the grid electrode 22b. The effective surface potentials are determined to −655 volt and −660 volt, respectively. Similarly, when the magnification is in the range of 0.54 to 0.50, the bias voltage is −820 volt and the effective surface potential is −700 volt.

Figure 8B:
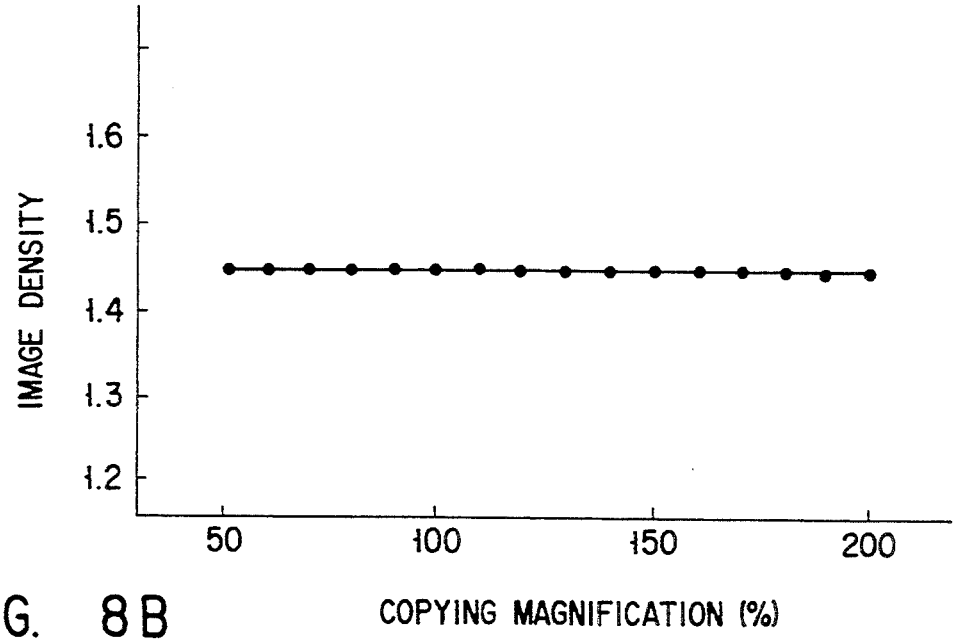
FIG. 8B is a graph showing the relationship between the copying magnification and the image density in the copying apparatus shown in FIGS. 1 to 7.

As a result, as shown in FIG. 8B, the image density of the copied image is kept substantially constant, I.D. value (Macbeth density) ≈1.4, irrespective of the copying magnification. Since the potential of the grid voltage is uniformly increased, the latent image potential becomes higher on the center area than on both end portions. However, because of the characteristics of the toner used in the electrophotographic process, even when the latent image potential exceeds a desired level, the image density does not increase beyond the saturated level. Therefore, a substantially constant image density is maintained in all image areas.

According to this embodiment, the grid bias value is set in ten levels in accordance with the copying magnification. However, the number of levels of the grid bias value is not limited to ten. The value of a suitable grid bias at the least reduction magnification is measured. This measured value is compared with the value of a grid bias at the 100% copying mode, and the difference therebetween is equally divided into a desired number of grid bias levels.

According to the present invention, the charging unit for electrifying the photosensitive drum with desired charge is controlled so that the effective surface potential on the photosensitive drum increases as the copying magnification decreases in the case where the copying magnification is less than 100%. Therefore, the copied image with a little difference in image density between the center area and side areas in the scanning direction can be obtained, irrespective of the copying magnification.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An image forming apparatus for forming an electrostatic image of varying sizes on an image bearing member and supplying toner to the electrostatic image so as to develop the image, comprising:

means for exposing an original having an image on it;

means for charging the image bearing member;

means for setting a magnification of an image formation;

first means for controlling said exposing means to increase an amount of exposure in accordance with the magnification when the magnification set by said setting means is less than 1.00, and to decrease the amount of exposure in accordance with the magnification when the magnification set by said setting means is more than 1.00;

second means for controlling said charging means to increase an amount of charge in accordance with the magnification when the magnification set by said setting means is less than 1.00;

means for forming the image of the original, exposed by the exposing means, on the image bearing means which has been charged by the charging means; and means for changing a size of the image to be formed on the image bearing member by the forming means in accordance with the magnification set by the setting means.

2. An apparatus according to claim 1, further comprising:

first storing means for storing data indicative of the level of exposure in accordance with the magnification and second storing means for storing data indicative of the level of charge in accordance with the magnification.

3. An apparatus according to claim 1, wherein said charging means includes a wire electrode so as to a main charging unit and a grid electrode so as to a bias charging unit.

4. An image forming apparatus for forming an electrostatic image on an image bearing member and supplying toner to the electrostatic image so as to develop the image, comprising:

means for exposing an original having an image on it;

first charging means for charging the image bearing member;

second charging means for further charging the image bearing member;

means for setting a magnification of an image formation;

first means for controlling said exposing means to increase an amount of exposure in accordance with the magnification when the magnification set by said setting means is less than 1.00, and to decrease the amount of exposure in accordance with the magnification when the magnification set by said setting means is more than 1.00, and second means for controlling said first charging means and said second charging means to increase an output difference between said first and second charging means in a case that the magnification is reduced by said setting means.

5. An apparatus according to claim 4, wherein said second means controls said second charging means in a stepwise manner in accordance with a plurality of control levels obtained by dividing a range of magnification which can be set by said setting means.

6. An apparatus according to claim 5, wherein said second means controls an output from said second charging means in accordance with a plurality of control levels obtained by dividing the range of magnification.

* * * * *

UNITED STATES PATENT AND TRADEMARK OFFICE

CERTIFICATE OF CORRECTION

PATENT NO. : 5,436,702
DATED : July 25, 1995
INVENTOR(S) : Tetsuo Katoh

It is certified that error appears in the above-indentified patent and that said Letters Patent is hereby corrected as shown below:

On the title page: Item [73] should read
--Kabushiki Kaisha Toshiba --.

Signed and Sealed this

Nineteenth Day of December, 1995

*Attest:*

Bruce Lehman

BRUCE LEHMAN

*Attesting Officer*

*Commissioner of Patents and Trademarks*